US007083886B2

(12) United States Patent
Yokota et al.

(10) Patent No.: US 7,083,886 B2
(45) Date of Patent: Aug. 1, 2006

(54) SINGLE LAYERED ELECTROPHOTOGRAPHIC PHOTORECEPTOR

(75) Inventors: Saburo Yokota, Gyeonggi-do (KR); Hwan-Koo Lee, Gyeonggi-do (KR); Beam-Jun Kim, Gyeonggi-do (KR); Kyung-yol Yon, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 105 days.

(21) Appl. No.: 10/684,556

(22) Filed: Oct. 15, 2003

(65) Prior Publication Data

US 2004/0121252 A1 Jun. 24, 2004

(30) Foreign Application Priority Data

Dec. 13, 2002 (KR) ..... 10-2002-0079742

(51) Int. Cl.
*G03G 5/06* (2006.01)

(52) U.S. Cl. ..... 430/78; 430/79; 399/159

(58) Field of Classification Search ..... 430/78, 430/79; 399/159
See application file for complete search history.

(56) References Cited

U.S. PATENT DOCUMENTS

| | | | | |
|---|---|---|---|---|
| 3,397,086 | A | 8/1968 | Bartfai | |
| 3,484,237 | A | 12/1969 | Shattuck et al. | |
| 3,615,414 | A | 10/1971 | Light | |
| 5,234,785 | A | 8/1993 | Itami et al. | |
| 5,350,655 | A * | 9/1994 | Oshiba et al. | 430/78 |
| 5,380,613 | A * | 1/1995 | Ueda et al. | 430/58.35 |

FOREIGN PATENT DOCUMENTS

| | | |
|---|---|---|
| JP | 54-001633 | 1/1979 |
| JP | 61-217050 | 9/1986 |
| JP | 62-229253 | 10/1987 |
| JP | 63-116158 | 5/1988 |

OTHER PUBLICATIONS

Korean Office Action dated Nov. 30, 2004 in corresponding Korean Patent Application No. 10-2002-0079742.

* cited by examiner

*Primary Examiner*—Mark A. Chapman
(74) *Attorney, Agent, or Firm*—Staas & Halsey LLP

(57) ABSTRACT

A single layered electrophotographic photoreceptor includes a photosensitive layer having having at least a charge generating material, a charge transport material and a binder on a conductive support, wherein the charge generating material is amorphous titanylphthalocyanine, and the photosensitive layer is a hindered phenol compound and/or hindered amine compound.

10 Claims, 3 Drawing Sheets

SINGLE LAYERED ELECTROPHOTOGRAPHIC PHOTORECEPTOR

CROSS-REFERENCE TO RELATED APPLICATIONS

This application claims the benefit of Korean Application No. 2002-79742, filed Dec. 13, 2002, in the Korean Intellectual Property Office, the disclosure of which is incorporated herein by reference.

BACKGROUND OF THE INVENTION

1. Field of the Invention

The present invention relates to a single-layered electrophotographic photoreceptor, and more particularly, to an electrophotographic photoreceptor having high sensitivity, a low residual potential and improved cycling stability.

2. Description of the Related Art

In general, an electrophotographic photoreceptor includes a photosensitive layer, including a charge generating material, charge transport material and a binder resin, formed on a conductive support. As photosensitive layers, function-separation type photoreceptors having a laminate structure in which a charge generating layer and a charge transport layer are laminated, have been widely used.

Photoreceptors have been viewed as having a drawback due to reacting readily with active substances (i.e., corona discharge induced products) such as ozone and nitrogen oxides. However, in recent years, since single layered photoreceptors that can be manufactured by a simplified process have been shown to be advantageous due to effective chargeability and due to the generation of only a small amount of ozone during the positive corona discharge that occurs during the charging process, such photoreceptors have attracted considerable attention, and extensive studies are underway.

Representative examples of conventional single layered electrophotographic photoreceptors include a photoreceptor comprising a PVK/TNF charge transport complex as disclosed in U.S. Pat. No. 3,484,237, a photoreceptor comprising photoconductive phthalocyanine dispersed in a resin as disclosed in U.S. Pat. No. 3,397,086, a photoreceptor comprising a thiapyrylium and polycarbonate aggregate and a charge transport material dispersed in a resin as disclosed in U.S. Pat. No. 3,615,414. However, the disclosed photoreceptors do not have sufficient electrostatic properties and are considerably limited in selection of materials. Also, since such materials are harmful, the materials are not employed any longer.

Currently, single layered photoreceptors having a charge generating material, a hole transport material and an electron transport material dispersed in a resin, as described in Japanese Patent Publication 54-1633, have become the subject of development. Since such photoreceptors are functionally separated by materials used, charge generation and charge transport, a wide variety of materials may be selected. Also, since the concentration of the charge generating material may be reduced, the functional, chemical durability of the photosensitive layer may be enhanced.

Single layered photoreceptors that have been proposed to date exhibit a large residual potential and poor cycling stability, which may be caused by several reasons. That is to say, in a single layered photoreceptor, since charges are generated at a charge generating material uniformly distributed in a photosensitive layer, hole/electron injection and transport must be highly efficiently performed. In particular, electrons having low mobility are liable to remain at a low electrical field where transport efficiency is low. In a single photoreceptor, light absorption, i.e., light excitation, is maximum at the surface of the photoreceptor and is exponentially reduced inside the photoreceptor. Even if a charge generating material present in a deep portion of the photosensitive layer is excited to generate ion pairs, electrons are recombined with holes having migrated from a portion closer to the surface to then be neutralized. Thus, it is presumed that electrons do not substantially contribute to charge generation. Rather, charge generation is mainly undertaken by an electron generating material present at a portion closest to the surface of the photoreceptor.

A residual potential is definitely proportional to a distance between a residual charge in the photosensitive layer and a surface charge. Thus, the shorter the distance is, the more advantageous the residual potential characteristic becomes. Since the distance depends upon an average distance between dispersing particles, a charge generating material having many primary particles, that is, a high concentration, and a small particle diameter is advantageous.

However, in a single photoreceptor, increasing the concentration of a charge generating material may give rise to deterioration in chargeability, resulting in an increase in dark decay. Thus, it is more effective to uniformly distribute a charge generating material having a particle size as small as possible.

Phthalocyanine compounds are widely used as charge generating materials. However, it is known that the phthalocyanine compound exhibits quite different electrophotographic properties depending on the kinds of central metals or crystal forms. In general, various crystal forms are known with respect to the phthalocyanine compounds, and representative examples thereof include an alpha ($\alpha$) form obtained by an acid-pasting method in which strong aqueous sulfuric acid is added dropwise to cold water to be precipitated, and a beta ($\beta$) form obtained by crystallization in a soluble solvent such as $\alpha$-chloronaphthalene. However, the crystal forms are termed just for convenience' sake in view of the preparation method, but are not commonly applied to various phthalocyanine compounds having different central metals.

A compound having tetravalent titanium forming a double bond with an oxygen atom at the center of a phthalocyanine ring is termed titanylphthalocyanine, from which two kinds of stable crystal forms are identified through crystal growth using sublimation. Atomic arrangement of each crystal form was determined by X-ray structural analysis by W. Hiller et al. in Zeit Fur Kristal., 159 p. 173 (1982).

Japanese Patent Publication No. 61-217050 discloses a single layered photoreceptor in which $\alpha$-crystal form titanylphthalocyanine obtained by hydrolyzing dichlorotitanium phthalocyanine by aqueous ammonia is dispersed in a resin, the crystal form of the titanylphthalocyanine being the same crystal form as that obtained by the acid pasting treatment and termed an $\alpha$-crystal form. According to the X-ray diffraction spectrum, the crystal form falls into Phase II, which was studied by W. Hiller et al.

Japanese Patent Publication Nos. 62-229253 and 63-116158 disclose amorphous titanylphthalocyanine obtained by the acid-pasting treatment and exhibiting no X-ray diffraction spectral peak, and an electrophotographic photoreceptor using the amorphous titanylphthalocyanine. The amorphous titanylphthalocyanine has a very small primary particle diameter.

However, when such amorphous titanylphthalocyanine is used for a photosensitive layer, a residual potential is reduced, but dark decay becomes severe, resulting in poor chargeability and cycling stability.

SUMMARY OF THE INVENTION

The present invention provides an electrophotographic photoreceptor having high sensitivity, a low residual potential and improved cycling stability.

Additional aspects and advantages of the invention will be set forth in part in the description which follows and, in part, will be obvious from the description, or may be learned by practice of the invention.

In accordance with an aspect of the present invention, a single layered electrophotographic photoreceptor comprises a photosensitive layer having at least a charge generating material, a charge transport material and a binder on a conductive support, wherein the charge generating material is amorphous titanylphthalocyanine, and the photosensitive layer includes a hindered phenol compound having at least three structural units represented by Formula 1 in a single molecule:

Formula 1

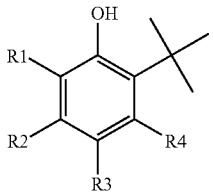

wherein $R_1$~$R_4$ are independently selected from the group consisting of a hydrogen atom, a substituted or unsubstituted $C_1$–$C_{20}$ alkyl group, a substituted or unsubstituted $C_6$–$C_{20}$ aryl group, a substituted or unsubstituted $C_1$–$C_{20}$ alkoxy group, a hydroxy group, a halogen atom, and a substituted or unsubstituted amino group.

The single layered electrophotographic photoreceptor may be implemented in an electrophotographic cartridge, an electrophotographic drum and/or an image forming apparatus.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
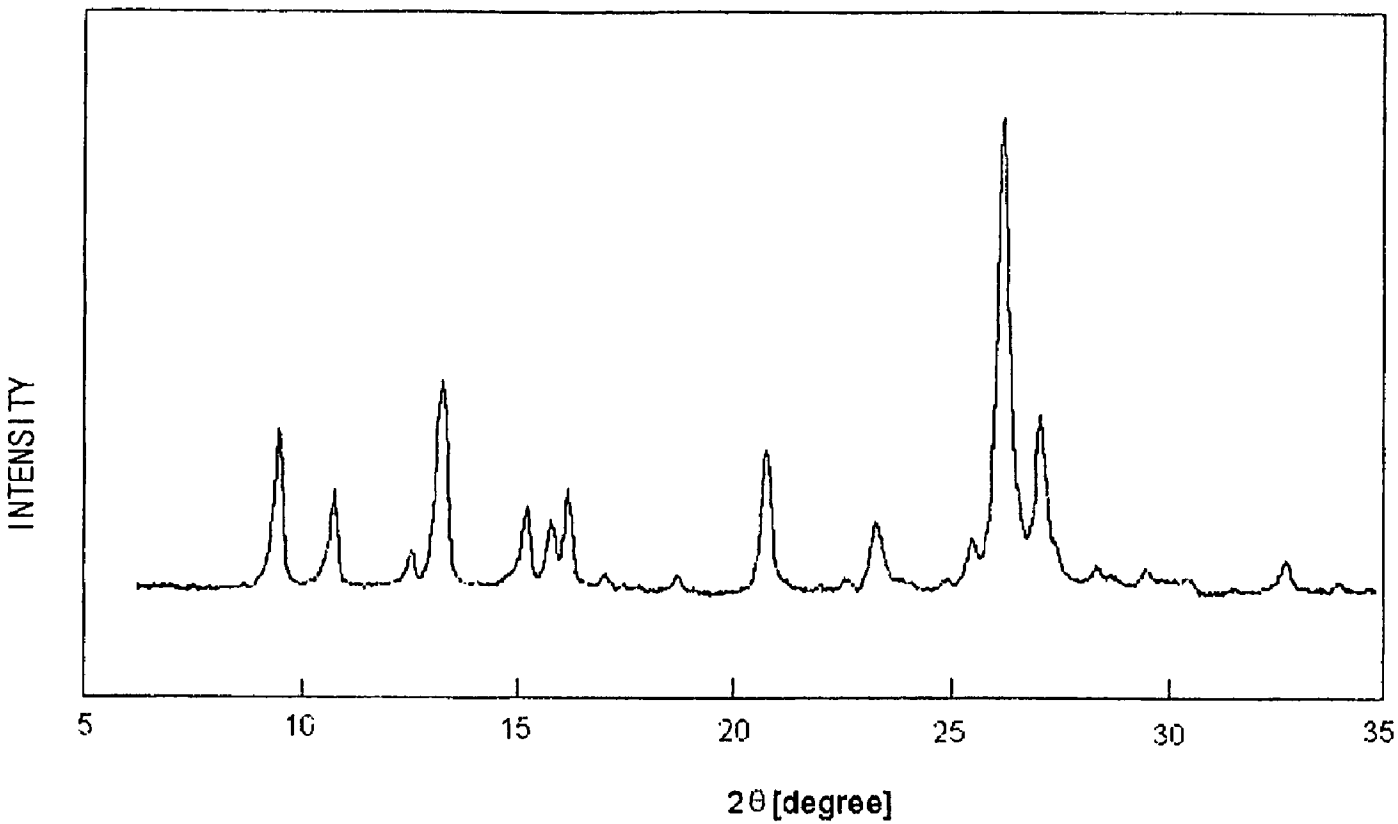
FIG. 1 is an X-ray diffraction spectrum of β-titanylphthalocyanine used as a raw material in Example 1.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

In order to attain a single layered electrophotographic photoreceptor having high sensitivity, a low residual potential and stable cycle characteristics, the present invention is directed to improvement of charge characteristics of the photoreceptor by adding a hindered phenol compound having a predetermined structure to a photosensitive layer.

The hindered phenol compound indicates a phenol structural unit having a bulky group such as a branched alkyl group adjacent to a phenolic hydroxy group.

In a conventional single layered photoreceptor, use of amorphous titanylphthalocyanine leads to ineffective charge properties, due to the amorphous titanylphthalocyanine having a small primary particle diameter and a wide surface area. On the other hand, in the photoreceptor according to the present invention, particles of a charge generating material are dispersed in a charge transport material, an interface area between the charge generating material and the charge transport material is greatly increased, thus activating dark decay, which contributes to chargeability, as follows.

The charge generating material is polarized in a high electric field.

Negative charges (electrons) from the charge generating material are injected into and transported to the charge transport material. The negative charges are neutralized with positive surface charges. Free positive charges (holes) are generated.

In the present invention, use of a hindered phenol compound in the manufacture of a photosensitive layer considerably increases charge properties, which are described as follows.

In general, a hindered phenol compound is often used as an antioxidant because it prevents radical generation while peroxide is decomposed to oxide. Meanwhile, the release of negative charges can be regarded as a kind of oxidation of the charge generating material. Thus, it is understood that the hindered phenol compound serving as an antioxidant functions to suppressing dark decay to a certain degree.

The reason of prominent effect by peculiar hindered phenol compounds according to present invention is probably due to the state of molecular distribution in the photosensitive layer, wherein plural hindered phenol groups are localized even when molecularly dispersed in the binder and able to show stronger suppressing effect rather than those using hindered phenol compounds like BHT (butylhydroxytoluene) with single functional group in one molecule, in which the hindered phenol groups are evenly dispersed in the binder and the function of antioxidant is diluted and weakened.

Thus, it is understood that the hindered phenol compound serving as an antioxidant functions to aid in suppressing oxidation.

A single layered electrophotographic photoreceptor according to the present invention is now described in more detail.

The single layered electrophotographic photoreceptor according to the present invention may have a structure in which a photosensitive layer is formed on a conductive support. As the conductive support, a metal or plastic, drum- or belt-shaped support is typically used.

The photosensitive layer is a single layer which has amorphous titanylphthalocyanine as a charge generating material, a charge transport material (a hole transport material and an electron transport material), and a hindered phenol compound having a specific structural unit.

The titanylphthalocyanine is represented by Formula 3:

Formula 3

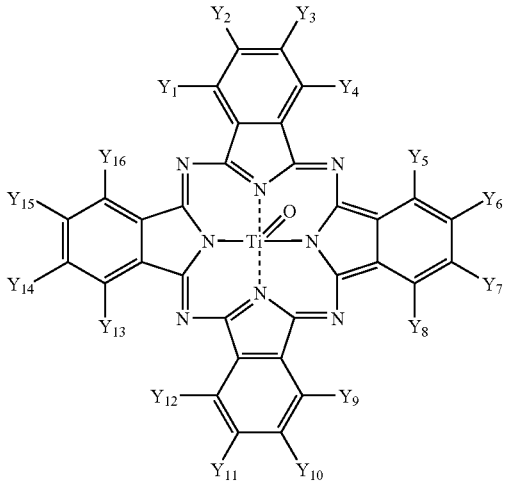

wherein $Y_1$ through $Y_{16}$ are independently a hydrogen or halogen atom.

The term "amorphous" is generally applied to solid states whose molecules are arranged in a random manner, rather than in a crystalline, regular arrangement, by crystallography. However, the term "amorphous" used herein simply refers to a state in which clear diffraction peaks are not observed in X-ray diffraction spectral analysis.

Titanylphthalocyanine may be obtained by using the acid-pasting treatment or by pulverizing crystalline phthalocyanine using a dry- or wet-type milling device. In particular, the acid-pasting treatment is suitably applied for treatment of a large quantity of materials. In some cases, as disclosed in the reference, that is, Japanese Patent Publication No. 61-217050, highly crystalline titanylphthalocyanine may be produced. In this case, amorphous titanylphthalocyanine may be obtained by pulverization.

The acid-pasting treatment, which is often used for purification of pigments or crystal transformation, is generally prepared in the following manner:

(1) Phthalocyanine is dissolved in concentrated sulfuric acid to prepare a solution.

(2) The solution is poured into cold water to precipitate phthalocyanine.

(3) The precipitated phthalocyanine is separated.

(4) The separated phthalocyanine is washed with water or a solvent.

For convenience' sake, the single layered photoreceptor according to the present invention may be used in combination with another charge generating material within the range in which the effects and advantages of the present invention are not adversely affected. Examples of the charge generating material used for the photosensitive layer include organic materials, such as phthalocyanines having different crystal forms from amorphous forms or phthalocyanine pigments having different central metals compared with that of titanylphthalocyanine, azo pigment, quinone pigment, perylene pigment, indigo pigment, bisbenzoimidazole pigment, quinacridone pigment, azulenium dye, squarylium dye, pyrylium dye, triarylmethane dye, cyanine dye, and inorganic materials such as amorphous silicon, amorphous selenium, trigonal selenium, tellurium, selenium-tellurium alloy, cadmium sulfide, antimony sulfide or zinc sulfide. The charge generating materials are not limited to those listed herein, and may be used alone or in combination of 2 or more mixtures thereof.

The amount of the charge generating material contained in the photosensitive layer is from 2 to 10 parts by weight per 100 parts by weight of the charge generating material, the charge transport material and the hindered phenol compound contained in the photosensitive layer. If the amount of the charge generating material is less than 2 parts by weight, the light absorptivity of the photosensitive layer is lowered, and the energy loss of irradiated light is increased, resulting in a decrease of sensitivity. If the amount of the charge generating material is greater than 10 parts by weight, the chargeability thereof is considerably lowered and the trap density is also increased, lowering conductivity and sensitivity.

As the hindered phenol compound, a compound having at least three structural units represented by Formula 1 in its molecule may be utilized:

Formula 1

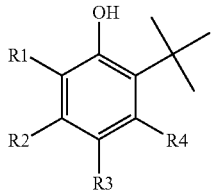

wherein R1, R2, R3, and R4 are independently selected from the group consisting of a hydrogen atom, a substituted or unsubstituted $C_1$–$C_{20}$ alkyl group, a substituted or unsubstituted $C_6$–$C_{20}$ aryl group, a substituted or unsubstituted $C_1$–$C_{20}$ alkoxy group, a hydroxy group, a halogen atom, and a substituted or unsubstituted amino group.

In particular, the $C_1$–$C_{20}$ alkyl group is preferably a $C_1$–$C_6$ alkyl group.

Examples of the compound having at least three structural units represented by Formula 1 include IRGANOX-1010, IRGANOX-1330 and IRGANOX-3114 manufactured by CIBA SPECIALTY CHEMICALS; and CYANOX-1741, CYANOX-1790 and CYANOX-2110 manufactured by CYTEC INDUSTRIES. The compounds are all readily commercially available. Here, IRGANOX-3114 has the same structural formula with CYANOX-1741 manufactured by CYTEC INDUSTRIES, and IRGANOX-1010 has the same structural formula with CYANOX-2110.

Irganox-1330

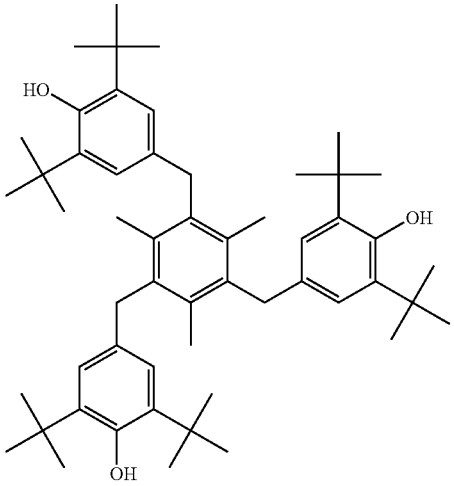

The amount of the hindered phenol compound is 0.1–10 parts by weight per 100 parts by weight of a mixture of the charge generating material, the charge transport material, the hindered phenol compound and the binder, more preferably, 1–5 parts by weight.

The photosensitive layer according to the present invention may further include a hindered amine compound. Examples of the hindered amine compound include a compound having at least two structural units represented by Formula 2:

Formula 2

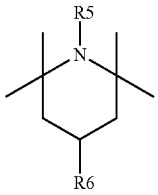

wherein $R_5$ and $R_6$ are independently selected from the group consisting of a hydrogen atom, a substituted or unsubstituted $C_1$–$C_{20}$ alkyl group, a substituted or unsubstituted $C_6$–$C_{20}$ aryl group, a substituted or unsubstituted C1–C20 alkoxy group, a hydroxy group, a halogen atom, a substituted or unsubstituted amino group The substituted or unsubstituted $C_1$–$C_{20}$ alkyl group is preferably a $C_1$–$C_4$ alkyl group.

As such compounds, TINUVIN-292, 622, and CHIMASSORB-119, 944 manufactured by CIBA SPECIALTY CHEMICALS; and CYASORB UV-3346,3529 manufactured by CYTEC INDUSTRIES, are marketed and readily commercially available.

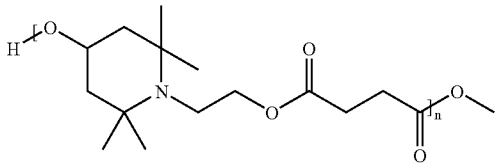

Tinuvin-622 n = 10-13

CHIMASSORB 944

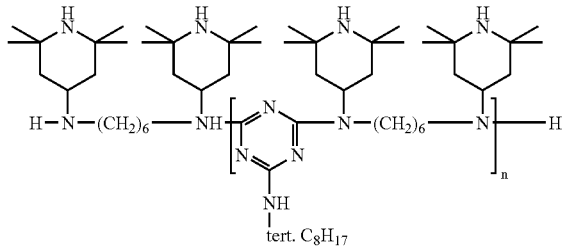

Mn = 2000-3100

CHIMASSORB 119

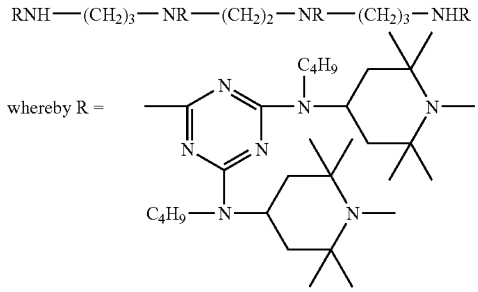

2286

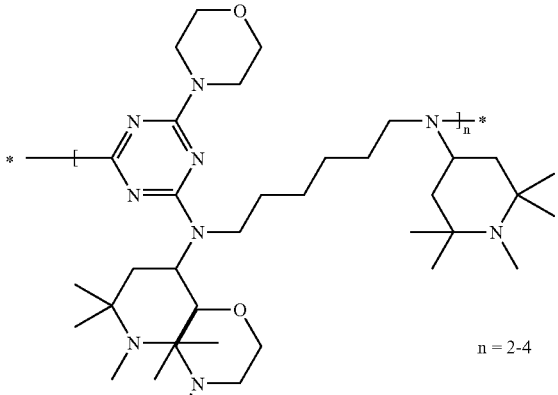

n = 2-4

Cyasorb UV-3529

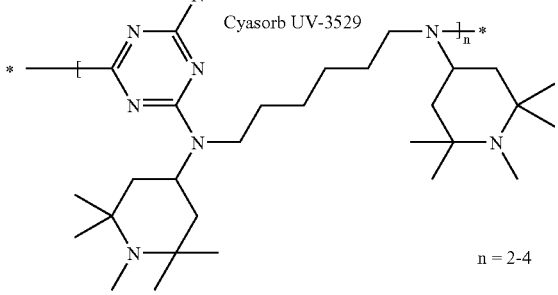

n = 2-4

Cyasorb UV-3529

The amount of the hindered amine compound added is 0.1 to 5 parts by weight per 100 parts by weight of a mixture of the charge generating material, the charge transport material, the hindered amine compound and the binder, more preferably, 0.2 to 2 parts by weight. If the amount of the hindered amine compound is less than 0.1 parts, a cycling stability improving effect is negligible. If the amount of the hindered amine compound is greater than 5 parts, the sensitivity is undesirably reduced.

The charge transport materials useful in the single layered electrophotographic photoreceptor according to the present invention include hole transport materials and electron transport materials.

The amount of the charge transport material contained in the photosensitive layer is from 10 to 60 parts by weight per 100 parts of the total weight of the charge generating material, the charge transport material, the hindered phenol compound and the binder contained in the photosensitive layer. If the amount of the charge transport material is less than 10 parts, charge transporting capability is reduced so that the light sensitivity of the photosensitive layer is lowered, and a residual potential is undesirably increased. If the amount of the charge transport material is greater than 60 parts, the proportion of the resin contained in the photosensitive layer is reduced, and sufficient coating strength cannot be obtained. Also, in the charge transport material, the proportion of the electron transport material is preferably in the range of 0.1 to 10 parts by weight per part of the hole transport material. In the case where higher hole transport capability among various photosensitive characteristics is preferred, the proportion of the hole transport material is increased. In the opposite case, the proportion of the electron transport material is preferably increased.

Examples of the hole transport material include nitrogen-containing cyclic compounds or condensed polycyclic compounds such as pyrene compounds, carbazole compounds, hydrazone compounds, oxazole compounds, oxadiazole compounds, pyrazoline compounds, arylamine compound, arylmethane compounds, benzidine compounds, thiazole compounds or styryl compounds. Also, polymer compounds or polysilane compounds having the substituents of the nitrogen-containing cyclic compounds or condensed polycyclic compounds in their main or side chains may be used.

Examples of the electron transport material include, but are not limited to, electron attracting low-molecular weight compounds such as benzoquinone compounds, cyanoethylene compounds, cyanoquinodimethane compounds, fluorenone compounds, xanthone compounds, phenantraquinone compounds, anhydrous phthalic acid compounds, thiopyrane compounds or diphenoquinone compounds. Electron transporting polymer compounds or electron transporting pigments may also be used.

The photosensitive layer of the present invention may include a binder resin. Preferred examples of the binder resin include, but are not limited to, electrically insulating polymers, for example, polycarbonate, polyester, methacryl resin, acryl resin, polyvinyl chloride, polyvinylidene chloride, polystyrene, polyvinyl acetate, silicon resin, silicon-alkyd resin, styrene-alkyd resin, poly-N-vinylcarbazole, phenoxy resin, epoxy resin, polyvinyl butyral, polyvinyl acetal, polyvinyl formal, polysulfone, polyvinyl alcohol, ethyl cellulose, phenol resin, polyamide, carboxy-ethylcellulose and polyurethane. The polymers may be used alone or in combination of two or more kinds of the materials. The amounts of the binder is 30–70 parts by weight per 100 parts by weight of a mixture of the charge generating material, the charge transport material, the hindered phenol compound and the binder.

Examples of the unsubstituted $C_1$–$C_{20}$ alkyl group used in the present invention include methyl, ethyl, n-propyl, isopropyl, n-butyl, isobutyl, sec-butyl, t-butyl, pentyl, iso-amyl and hexyl. Here, at least one hydrogen atom in the alkyl group may be substituted by a halogen atom, a hydroxy group, a nitro group, a cyano group, an amino group, an amidino group, hydrazine, hydrazone, a carboxyl group or a sulfone group.

Examples of the $C_1$–$C_{20}$ alkoxy group include methoxy, ethoxy, propoxy, isobutyloxy, sec-butyloxy, pentyloxy, isoamyloxy, hexyloxy and the like. Here, at least one hydrogen atom in the alkoxy group may be substituted by halogen atom, a hydroxy group, a nitro group, a cyano group, an amino group, an amidino group, hydrazine, hydrazone, a carboxyl group or a sulfonic acid group.

The aryl group, alone or in combination, means a $C_6$–$C_{20}$ carbocyclic aromatic system containing one or more rings, wherein such rings may be attached together in a pendent manner or may be fused. Examples of the aryl group include aromatic radicals such as phenyl, naphtyl or tetrahydronaphtyl. Phenyl or naphtyl is generally preferred. Also, at least one hydrogen atom in the aryl group can be substituted by a halogen atom, a hydroxy group, a nitro group, a cyano group, an amino group, an amidino group, hydrazine, hydrazone, a carboxyl group or a sulfonic acid group.

The unsubstituted amino group used in the present invention means a —$NH_2$ group, and examples thereof include —NH(R) or —$N(R)_2$. Here, R is a $C_1$–$C_{20}$ alkyl group.

A method of manufacturing the electrophotographic photoreceptor according to the present invention is now described.

A charge generating material, a charge transport material, a hindered phenol compound and a solvent are mixed to prepare a composition for forming a photosensitive layer. Here, examples of the solvent include alcohols, ketones, amides, ethers, esters, sulfones, aromatics, aliphatic halogenated hydrocarbons and the like.

The amount of the solvent is preferably from 150 to 2000 parts by weight per 100 parts by weight of the total weight of the charge generating material, the charge transport material, the hindered phenol compound and the binder contained in the photosensitive layer. If the amount of the charge generating material is out of the range specified above, the coating property may undesirably deteriorate.

Examples of the alcohols include ethanol, isopropyl alcohol and methanol. Examples of the ketones include acetone, methylethylketone and cyclohexanone. Examples of the amides include N,N-dimethylformamide and N,N-dimethylacetamide. Examples of the esters include ethyl acetate and methyl acetate. Examples of the sufones include dimethyl sulfoxide and sulforane. Examples of the aromatic group include benzene, toluene, xylene and chlorobenzene. Examples of the aliphatic halogenated hydrocarbons include chloroform, dichloromethane, dichloroethane and trichloroethane.

Next, the composition for forming the photosensitive layer is coated on a conductive support and dried, thus forming a photosensitive layer. Here, examples of the coating technique include a dip coating method, a ring coating method, a roll coating method or a spray coating method, but any coating technique may be applied to the electrophotographic photoreceptor according to the present invention.

The drying temperature is preferably in the range of 50 to 150° C. If the drying temperature is out of the range specified above, physical properties of the photosensitive layer undesirably deteriorate.

In the photoreceptor according to the present invention, the thickness of the photosensitive layer is preferably in the range of 5 to 50 μm.

Alternatively, an intermediate layer may be installed between the conductive support and the photosensitive layer for the purpose of enhancing adhesion or preventing charges from being injected from the support. Examples of the intermediate layer include, but are not limited to, an aluminum anodized layer, a resin-dispersed layer of metal oxide powder such as titanium oxide or tin oxide, and a resin layer such as polyvinyl alcohol, casein, ethylcellulose, gelatin, phenol resin or polyamide.

Also, the photosensitive layer may contain a plasticizer, a leveling agent, a dispersion-stabilizing agent, or a photo-stabilizing agent, in addition to the binder resin.

Examples of the photo-stabilizing agent include benzotriazole compounds, or benzophenone compound.

The present invention is explained in detail hereinbelow with reference to the examples. However, it should be understood that the invention is not limited to such specific examples.

EXAMPLE 1

β-titanylphthalocyanine was dissolved in concentrated sulfuric acid to give a 5% solution. The solution obtained was slowly added dropwise to excess ice water with stirring, to precipitate titanylphthalocyanine. The precipiptated titanylphthalocyanine was filtered and washed sequentially by pure water and acetone, followed by drying, thus obtaining amorphous titanylphthalocyanine powder.

Figure 2:
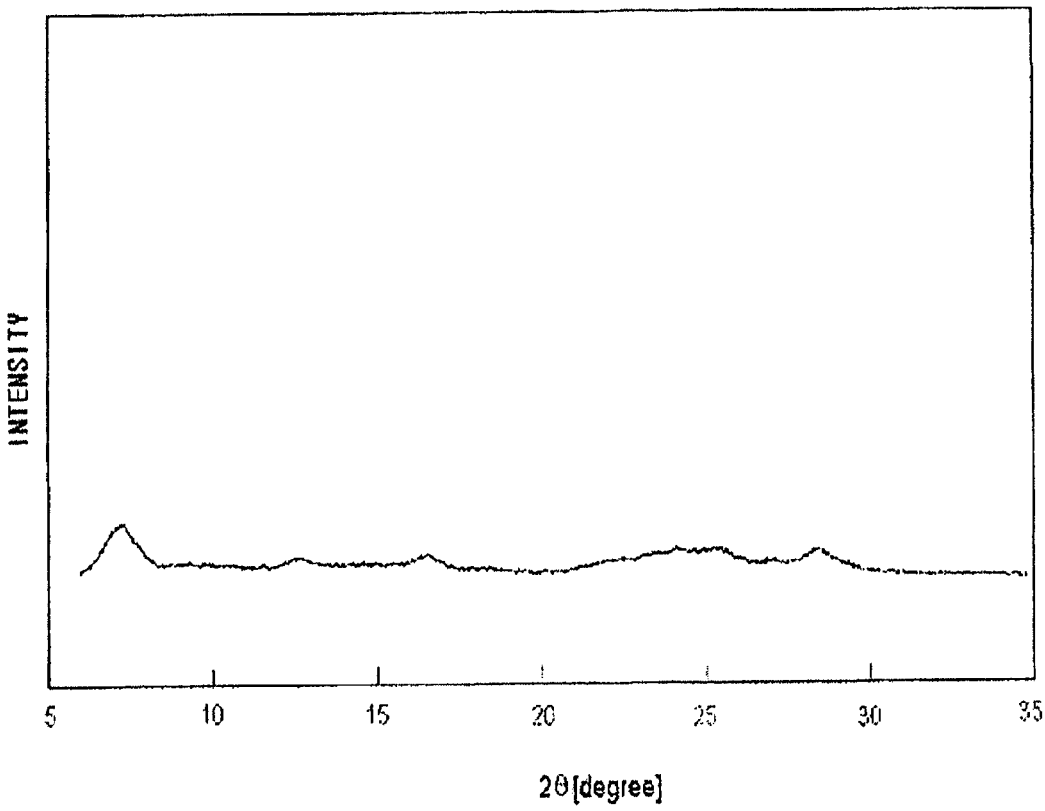
FIG. 2 is an X-ray diffraction spectrum of amorphous titanylphthalocyanine according to Example 1.

X-ray diffraction spectral analysis of the β-titanylphthalocyanine used as a raw material in Example 1 and the obtained amorphous titanylphthalocyanine are shown in FIGS. 1 and 2. Referring to FIGS. 1 and 2, the raw material β-titanylphthalocyanine, which exhibits clear diffraction peaks, is transformed into an amorphous compound.

35 parts by weight of the hole transport material represented by Formula 4, 15 parts by weight of the electron transport material represented by Formula 5, 5 parts by weight of the hindered phenol compound represented by Formula 6 (IRGANOX-3114 manufactured by CIBA SPECIALTY CHEMICALS) and 50 parts by weight of the polycarbonate Z resin were dissolved in 300 parts by weight of chloroform, giving a mixture (B).

The obtained amorphous titanyl phthalocyanine dispersion (A) and the mixture (B) was mixed in a weight ratio of 1:8 and uniformly dispersed using a homogenizer, thus obtaining a composition for forming a photosensitive layer. The composition was coated on an aluminum drum having a diameter of 30 mm by a ring-coating method and dried at 100° C., thus obtaining a 15 μm thick single layered electrophotographic photoreceptor.

Formula 4

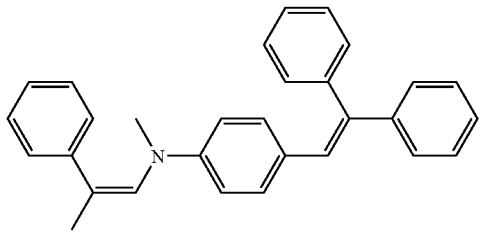

Formula 5

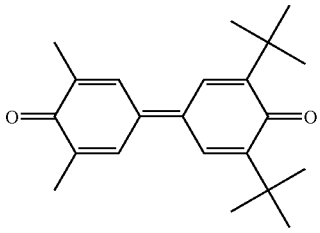

Formula 6

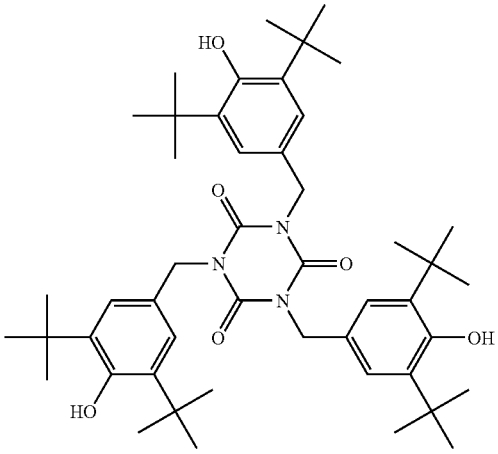

EXAMPLE 2

An electrophotographic photoreceptor was prepared in the same manner as in Example 1 except that 5 parts by weight a hindered phenol compound represented by Formula 7 (IRGANOX-1010) manufactured by CIBA SPECIALTY CHEMICALS) was used instead of 5 parts by weight of the hindered phenol compound represented by Formula 6:

Formula 7

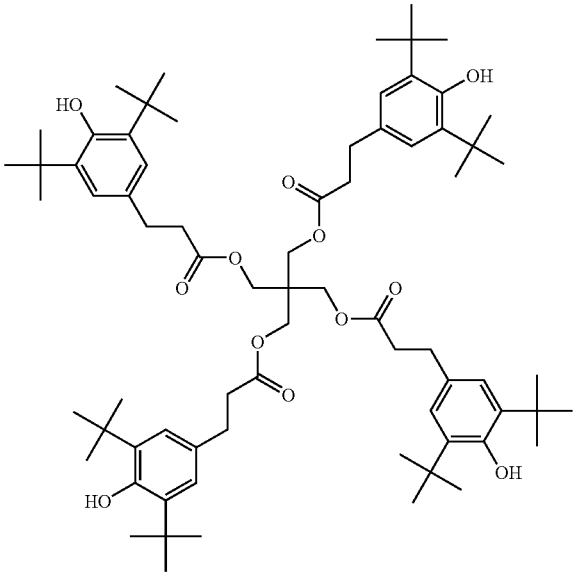

EXAMPLE 3

An electrophotographic photoreceptor was prepared in the same manner as in Example 1 except that 4 parts by weight of a hindered phenol compound represented by Formula 9 (CYANOX-1790 manufactured by CYTEC INDUSTRIES) and 1 part by weight of a hindered amine compound represented by Formula 9 (TINUVIN-292 manufactured by CIBA SPECIALTY CHEMICALS) were used instead of 5 parts by weight of the hindered phenol compound represented by Formula 6:

Formula 9

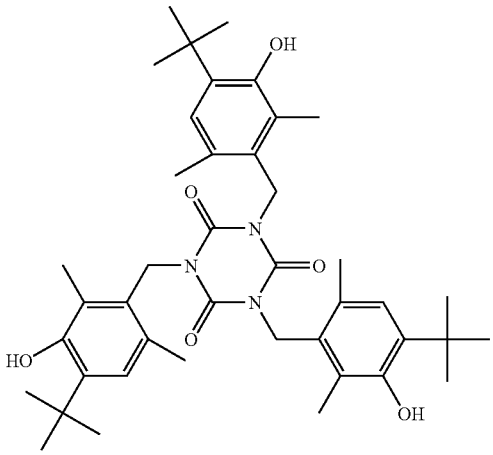

-continued

Formula 10

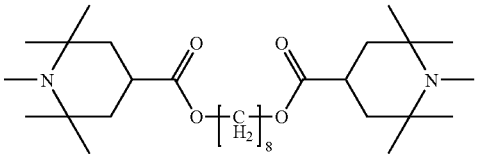

Comparative Example 1

An electrophotographic photoreceptor was prepared in the same manner as in Example 1 except that the hindered phenol compound represented by Formula 6 was not used in forming the composition for forming the photosensitive layer.

Comparative Example 2

An electrophotographic photoreceptor was prepared in the same manner as in Example 1 except that 5 parts by weight BHT represented by Formula 8 (manufactured by ALDRICH LTD.) was used instead of 5 parts by weight of the hindered phenol compound represented by Formula 6:

Formula 8

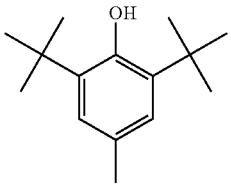

Comparative Example 3

An electrophotographic photoreceptor was prepared in the same manner as in Example 1 except that γ-titanylphthalocyanine was used instead of the amorphous titanylphthalocyanine.

In the electrophotographic photoreceptors prepared in Examples 1–3 and Comparative Examples 1–3, the following characteristics were evaluated.

(1) Electrostatic properties

Electrophotographic characteristics of the photoreceptors were measured using a PDT-2000 machine manufactured by QEA.

Measuring conditions are as follows.

A corona voltage +7.5 kV was applied to the respective photoreceptors and −7.5 kV was applied thereto, both charged with a relative speed of a charger and a photoreceptor being 100 mm/sec, immediately followed by irradiating monochrome light having a wavelength of 780 nm at a constant exposure energy of 10 mJ/m$^2$. Then, surface potential values resulting after exposure were recorded and compared with the exposure energy to investigate the relationship between the exposure energy and surface potential.

Here, the potential retention rate was set to a ratio of a surface potential without light irradiation being $V_0$(V) to a potential after 1 second at a dark place being $V_1$(V), that is, $V_1/V_0$.

A sensitivity potential $V_d$ was recorded 1 second after irradiating light of 10 mJ/m$^2$ and a residual potential $V_R$ was recorded 10 seconds after irradiating light of 10 mJ/m$^2$. For evaluation of cycling stability, 500 cycles of charging and discharging were repeated under the same conditions as in initial stage and potentials were measured in the same manner as above.

The measurement results are shown in Table 1.

TABLE 1

| Sample | Cycling | $V_o$ | $V_o/V_1$ | $V_d$ | $V_R$ |
|---|---|---|---|---|---|
| Example 1 | Before | 612 | 92 | 65 | 8 |
| | After | 608 | 90 | 70 | 12 |
| Example 2 | Before | 627 | 93 | 72 | 12 |
| | After | 622 | 91 | 78 | 17 |
| Example 3 | Before | 608 | 91 | 78 | 10 |
| | After | 612 | 91 | 79 | 12 |
| Comparative | Before | 543 | 81 | 52 | 7 |
| Example 1 | After | 398 | 67 | 46 | 13 |
| Comparative | Before | 592 | 88 | 75 | 15 |
| Example 2 | After | 579 | 86 | 80 | 21 |
| Comparative | Before | 615 | 93 | 85 | 32 |
| Example 3 | After | 604 | 90 | 92 | 43 |

As shown in Table 1, compared to the photoreceptor prepared in Comparative Example 1 in which amorphous titanylphthalocyanine was used alone, the photoreceptors prepared in Examples 1–3 in which amorphous titanylphthalocyanine and a specific hindered phenol compound were used in combination, exhibited good chargeability and cycling stability. In particular, the photoreceptor prepared in Example 1, in which a hindered phenol compound was used, showed an improved cycling characteristic.

The photoreceptor prepared in Comparative Example 2, in which BHT consisting of a general hindered phenol group was used, improved slightly in view of chargeability, compared to the photoreceptor prepared in Comparative Example 1. However, both of the photoreceptors prepared in Comparative Examples 1 and 2 had poor cycling stability. Also, the photoreceptor prepared in Comparative Example 3, in which a highly sensitive charge generating material exemplified by γ-titanylphthalocyanine was used, had good chargeability, but had a high residual potential and poor cycling stability compared to the photoreceptors prepared in Examples 1–3.

As described above, the single layered electrophotographic photoreceptor according to the present invention overcomes the conventional problems, such as poor chargeability, residual potential and cycle characteristics, thus realizing a more advantageous single layered photoreceptor.

Figure 3:
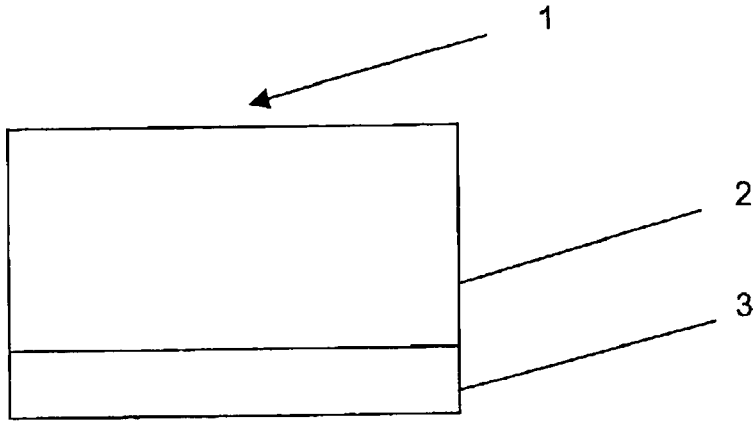
FIG. 3 is a block diagram illustrating (not to scale) an electrophotographic photoreceptor 1 comprising a photosensitive layer 2 installed on a conductive substrate 3 in accordance with an embodiment of the present invention.

FIG. 3 is a block diagram (not to scale) illustrating an electrophotographic photoreceptor 1 comprising a photosensitive layer 2 installed on a conductive substrate 3 in accordance with an embodiment of the present invention.

Figure 4:
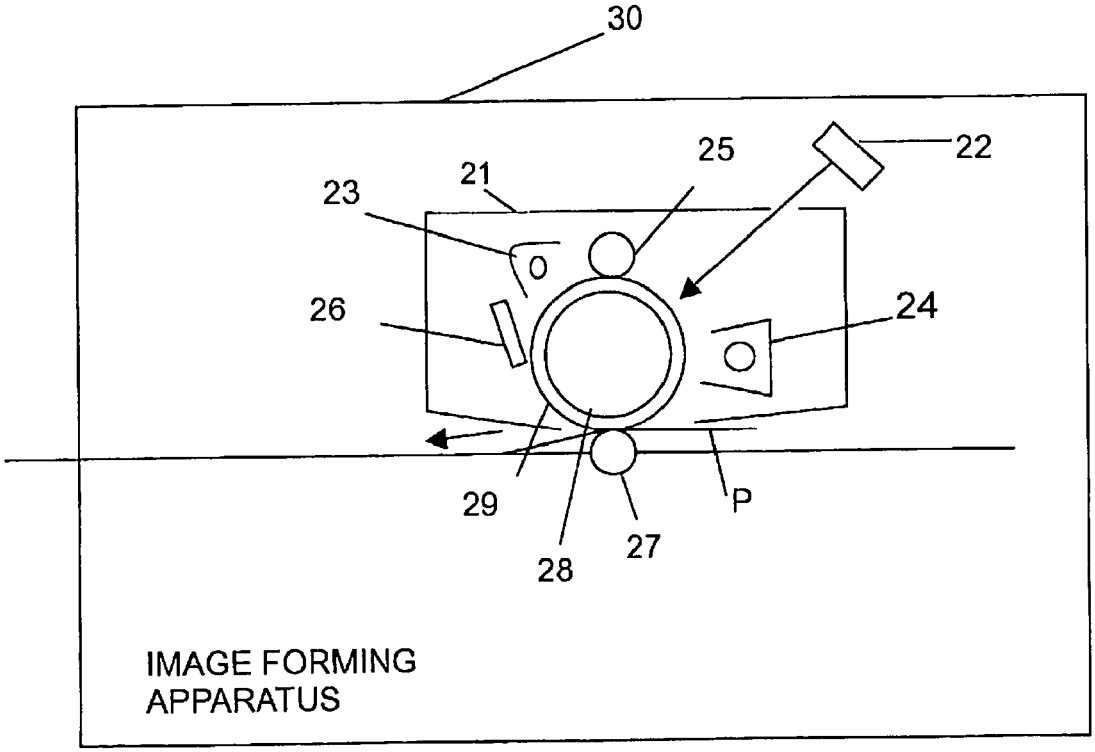
FIG. 4 is a schematic representation of an image forming apparatus, an electrophotographic drum, and an electrophotographic cartridge in accordance with selected embodiments of the present invention.

FIG. 4 is a schematic representation of an image forming apparatus 30, an electrophotographic drum 28, and an electrophotographic cartridge 21 in accordance with selected embodiments of the present invention. The electrophotographic cartridge 21 typically comprises an electrophotographic photoreceptor 29 and at least one of a charging device 25 that charges the electrophotographic photoreceptor 29, a developing device 24 which develops an electrostatic latent image formed on the electrophotographic photoreceptor 29, and a cleaning device 26 which cleans a surface of the electrophotographic photoreceptor 29. The electrophotographic cartridge 21 may be attached to or detached from the image forming apparatus 30, and the electrophotographic photoreceptor 29 is described more fully above.

The electrophotographic photoreceptor drum 28, 29 for an image forming apparatus 30, generally includes a drum 28 that is attachable to and detachable from the electrophotographic apparatus 30 and that includes an electrophotographic photoreceptor 29 disposed on the drum 28, wherein the electrophotographic photoreceptor 29 is described more fully above.

Generally, the image forming apparatus 30 includes a photoreceptor unit (e.g., an electrophotographic photoreceptor drum 28, electrophotographic photoreceptor 29), a charging device 25 which charges the photoreceptor unit, an imagewise light irradiating device 22 which irradiates the charged photoreceptor unit with imagewise light to form an electrostatic latent image on the photoreceptor unit, a developing unit 24 that develops the electrostatic latent image with a toner to form a toner image on the photoreceptor unit, and a transfer device 27 which transfers the toner image onto a receiving material, such as paper P, wherein the photoreceptor unit comprises an electrophotographic photoreceptor 29 as described in greater detail above. The charging device 25 may be supplied with a voltage as a charging unit and may contact and charge the electrophotographic receptor. Where desired, the apparatus may include a pre-exposure unit 23 to erase residual charge on the surface of the electrophotographic photoreceptor 29 to prepare for a next cycle.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A single layered electrophotographic photoreceptor comprising a photosensitive layer having at least a charge generating material, a charge transport material and a binder on a conductive support, wherein the charge generating material is amorphous titanylphthalocyanine, and the photosensitive layer includes a hindered phenol compound having at least three structural units represented by Formula 1 in a single molecule:

Formula 1

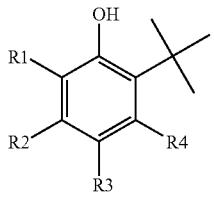

wherein R1, R2, R3 and R4 are independently selected from the group consisting of a hydrogen atom, an unsubstituted $C_1$–$C_{20}$ alkyl group, a substituted or unsubstituted $C_6$–$C_{20}$ aryl group, a halogen atom, and a substituted or unsubstituted amino group, wherein the photosensitive layer includes a hindered amine compound, and wherein the hindered amine compound is a compound having at least two structural units represented by Formula 2 in a single molecule:

Formula 2

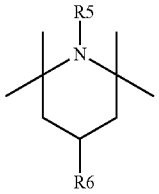

wherein $R_5$ and $R_6$ are independently selected from the group consisting of a hydrogen atom, a substituted or unsubstituted $C_6$–$C_{20}$ aryl group, a halogen atom, a substituted or unsubstituted amino group.

2. The single layered electrophotographic photoreceptor of claim 1, wherein the amount of the compound having at least three structural units represented by Formula 1 is 0.1–10 parts by weight per 100 parts by weight of a mixture of the charge generating material, the charge transport material, the hindered phenol compound and the binder.

3. The single layered electrophotographic photoreceptor of claim 1, wherein the amorphous titanylphthalocyanine is obtained by using an acid-pasting method.

4. The single layered electrophotographic photoreceptor of claim 1, wherein the amount of the hindered amine compound is 0.1–5 parts by weight per 100 parts by weight of a mixture of the charge generating material, the charge transport material, the hindered phenol compound and the binder.

5. The single layered electrophotographic photoreceptor of claim 1, wherein the amount of the charge generating material is 2–10 parts by weight per 100 parts by weight of a mixture of the charge generating material, the charge transport material, the hindered phenol compound and the binder.

6. The single layered electrophotographic photoreceptor of claim 1, wherein the amount of the charge transport material is 10–60 parts by weight per 100 parts by weight of a mixture of the charge generating material, the charge transport material, the hindered phenol compound and the binder.

7. The single layered electrophotographic photoreceptor of claim 1, wherein the charge transport material includes a hole transport material and an electron transport material, and the amount of the electron transport material is 0.1–10 parts by weight per 100 parts by weight of the hole transport material.

8. An electrophotographic cartridge, comprising:

a single layered electrophotographic photoreceptor comprising a photosensitive layer having at least a charge generating material, a charge transport material and a binder on a conductive support, wherein the charge generating material is amorphous titanylphthalocyanine, and the photosensitive layer includes a hindered phenol compound having at least three structural units represented by Formula 1 in a single molecule:

Formula 1

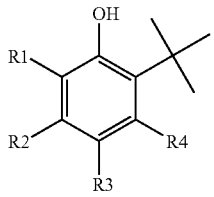

wherein R1, R2, R3 and R4 are independently selected from the group consisting of a hydrogen atom, an unsubstituted $C_1$–$C_{20}$ alkyl group, a substituted or unsubstituted $C_6$–$C_{20}$ aryl group, a halogen atom, and a substituted or unsubstituted amino group, wherein the photosensitive layer includes a hindered amine compound, and wherein the hindered amine compound is a compound having at least two structural units represented by Formula 2 in a single molecule:

Formula 2

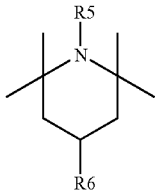

wherein $R_5$ and $R_6$ are independently selected from the group consisting of a hydrogen atom, an unsubstituted $C_1$–$C_{20}$ alkyl group, a substituted or unsubstituted $C_6$–$C_{20}$ aryl group, a halogen atom, a substituted or unsubstituted amino group; and at least one of:

a charging device that charges the electrophotographic photoreceptor;

a developing device which develops an electrostatic latent image formed on the electrophotographic photoreceptor; and a cleaning device which cleans a surface of the electrophotographic photoreceptor, wherein the electrophotographic cartridge is attachable to/detachable from an image forming apparatus.

9. An electrophotographic drum, comprising:

a drum that is attachable to and detachable from an electrophotographic apparatus; and a single layered electrophotographic photoreceptor, disposed on the drum, the single layered electrophotographic photoreceptor comprising:

a photosensitive layer having at least a charge generating material, a charge transport material and a binder on a conductive support, wherein the charge generating material is amorphous titanylphthalocyanine, and the photosensitive layer includes a hindered phenol compound having at least three structural units represented by Formula 1 in a single molecule:

Formula 1

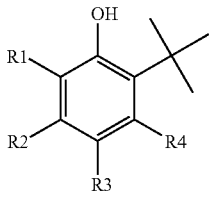

wherein R1, R2, R3 and R4 are independently selected from the group consisting of a hydrogen atom, an unsubstituted $C_1$–$C_{20}$ alkyl group, a substituted or unsubstituted $C_6$–$C_{20}$ aryl group, a halogen atom, and a substituted or unsubstituted amino group, wherein the photosensitive layer includes a hindered amine compound, and wherein the hindered amine compound is a compound having at least two structural units represented by Formula 2 in a single molecule:

Formula 2

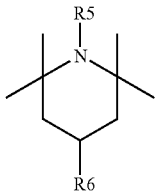

wherein $R_5$ and $R_6$ are independently selected from the group consisting of a hydrogen atom, an unsubstituted $C_1$–$C_{20}$ alkyl group, a substituted or unsubstituted $C_8$–$C_{20}$ aryl group, a halogen atom, a substituted or unsubstituted amino group.

10. An image forming apparatus comprising:

a photoreceptor unit comprising:

a single layered electrophotographic photoreceptor comprising:

a photosensitive layer having at least a charge generating material, a charge transport material and a binder on a conductive support, wherein the charge generating material is amorphous titanylphthalocyanine, and the photosensitive layer includes a hindered phenol compound having at least three structural units represented by Formula 1 in a single molecule:

Formula 1

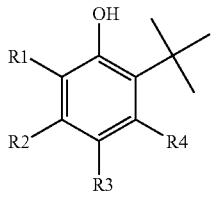

wherein R1, R2, R3 and R4 are independently selected from the group consisting of a hydrogen atom, an unsubstituted $C_1$–$C_{20}$ alkyl group, a substituted or unsubstituted $C_6$–$C_{20}$ aryl group, a halogen atom, and a substituted or unsubstituted amino group, wherein the photosensitive layer includes a hindered amine compound, and wherein the hindered amine compound is a compound having at least two structural units represented by Formula 2 in a single molecule:

Formula 2

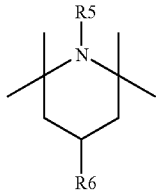

wherein $R_5$ and $R_6$ are independently selected from the group consisting of a hydrogen atom, an unsubstituted $C_1$–$C_{20}$ alkyl group, a substituted or unsubstituted $C_6$–$C_{20}$ aryl group, a halogen atom, a substituted or unsubstituted amino group;

a charging device which charges the photoreceptor unit;

an imagewise light irradiating device which irradiates the charged photoreceptor unit with imagewise light to form an electrostatic latent image on the photoreceptor unit;

a developing unit that develops the electrostatic latent image with a toner to form a toner image on the photoreceptor unit; and a transfer device which transfers the toner image onto a receiving material.

* * * * *

UNITED STATES PATENT AND TRADEMARK OFFICE

CERTIFICATE OF CORRECTION

PATENT NO. : 7,083,886 B2
APPLICATION NO. : 10/684556
DATED : August 1, 2006
INVENTOR(S) : Saburo Yokota et al.

It is certified that error appears in the above-identified patent and that said Letters Patent is hereby corrected as shown below:

Title Page Column 1 Item [75] (Inventors), Line 4, change "Kyung-yol" to --Kyung-Yol--.

Title Page Column 2 Item [57] (Abstract), Line 2, delete "having" before "at".

Column 17, Lines 58-59, after "comprising" insert --:--.

Column 19, Line 36, change "$C_8$-$C_{20}$" to --$C_6$-$C_{20}$--.

Signed and Sealed this

Second Day of January, 2007

JON W. DUDAS
*Director of the United States Patent and Trademark Office*